US005893557A

United States Patent [19]

Beduhn et al.

[11] Patent Number: 5,893,557

[45] Date of Patent: Apr. 13, 1999

[54] PRINTING PRESS WITH ELECTRONIC SIDE GUIDE

[75] Inventors: Gregory M. Beduhn, Rodney; Arthur E. Proctor, Bailey, both of Mich.

[73] Assignee: BecMar Corp, Bailey, Mich.

[21] Appl. No.: 08/747,365

[22] Filed: Nov. 12, 1996

Related U.S. Application Data

[60] Provisional application No. 60/006,620, Nov. 13, 1995.

[51] Int. Cl.[6] ..... B65H 7/02

[52] U.S. Cl. ..... 271/228; 271/254; 271/255

[58] Field of Search ..... 271/228, 238–240, 271/247, 249, 250, 252–255, 227

[56] References Cited

U.S. PATENT DOCUMENTS

| | | | |
|---|---|---|---|
| 1,941,248 | 12/1933 | Cottrell, 3D | 271/228 |
| 3,596,902 | 8/1971 | Siebke | 271/240 |
| 3,743,277 | 7/1973 | Bolza-Schünemann et al. . | |
| 3,941,053 | 3/1976 | Black et al. . | |
| 3,977,269 | 8/1976 | Linley, Jr. . | |
| 4,213,733 | 7/1980 | De George et al. . | |
| 4,260,149 | 4/1981 | Melzer . | |
| 4,319,743 | 3/1982 | Rood . | |
| 4,410,171 | 10/1983 | Kobayashi | 271/252 X |
| 4,451,029 | 5/1984 | Wildmann et al. . | |
| 4,591,143 | 5/1986 | Jeschke . | |
| 4,613,125 | 9/1986 | Jeschke . | |
| 4,615,520 | 10/1986 | Jeschke et al. . | |
| 4,702,469 | 10/1987 | Jeschke et al. . | |
| 4,726,501 | 2/1988 | Wiley . | |
| 4,805,892 | 2/1989 | Calhoun . | |
| 4,811,640 | 3/1989 | Fritsch | 271/228 X |
| 4,855,607 | 8/1989 | Eckl . | |
| 4,971,304 | 11/1990 | Lofthus . | |
| 5,048,816 | 9/1991 | Chun et al. . | |
| 5,169,140 | 12/1992 | Wenthe, Jr. . | |
| 5,219,159 | 6/1993 | Malachowski et al. | 271/228 |
| 5,273,274 | 12/1993 | Thomson et al. . | |
| 5,301,938 | 4/1994 | Casper . | |
| 5,342,039 | 8/1994 | Carlotta et al. . | |

*Primary Examiner*—Boris Milef

*Attorney, Agent, or Firm*—Price, Heneveld, Cooper, DeWitt and Litton

[57] ABSTRACT

A printing press electronic side guide registry apparatus for sheet stock to be printed on a printing press having a print cylinder, print stock forward motion advancer through the print cylinder, and a forward motion registry stop including a laterally movable side registry stock gripper device comprising a slide anvil positioned to be adjacent one surface of the stock, and a fluid cylinder positioned to be adjacent the opposite surface of the stock, aligned with the slide anvil to grip sheet stock therebetween, the slide anvil and fluid cylinder both mounted on a laterally shiftable support movable transverse to sheet stock forward motion, a nut connected to the support, and a laterally extending screw operably engaging the nut, a rotational servo motor drivingly connected with the screw for rotation of the screw to laterally drive the nut, support, fluid cylinder and slide anvil, and a sheet edge detector electrically associated with the servo motor to controllably actuate and deactuate the servo motor, whereby the presence of stock at a print station will cause the fluid cylinder to shift and grip the stock against the slide anvil and cause the servo motor to be actuated to rotate the screw and thereby move the nut, slide anvil, fluid cylinder and the stock toward the sensor, until the sensor senses the stock.

10 Claims, 7 Drawing Sheets

18
28
S
80

39
30
80
86
28
27
25
18
76

12
13
16
30
32
34
20

30
28
88

66
16'
62
64
62
66
72
70
80
82
66
16'
74
76

37
35

80
62
88
86

80
81
83

80
28
80
62
31
30
35
37

PRINTING PRESS WITH ELECTRONIC SIDE GUIDE

This Application claims the benefit of U.S. Provisional Application Ser. No. 60/606,620 filed Nov. 13, 1995.

BACKGROUND OF THE INVENTION

This invention relates to a printing press registry system, particularly for a cylinder press such as a screen printing press.

Cylinder presses such as those employing stencil screen printing require the stock that is to be printed is first position-registered prior to the print stroke. Typically, automatic side registry systems previously used on presses have involved a three point registry system to automatically register the stock prior to printing. When printing sheet stock, two permanent guides were typically located on the printing cylinder to achieve proper front-to-rear register of the sheet to the cylinder/stencil screen. The third registry point was on the side of the sheet to achieve proper side-to-side registry. This side registry was done automatically with either a push guide or a pull guide that moves laterally. A push guide is the simplest method of side registry, but is restricted to sheets stiff enough to allow pushing without buckling. Many materials are too thin or flexible to push, and therefore need to be pulled. Over the years several systems to do this have been employed. Each system had its benefits but also significant problems.

During the 1950s, several pull type registry devices used a pull guide formed of a slow moving wheel located just below the surface of the feed board. A pivoting pressure wheel was located above the sheet stock. At the appropriate time, the upper wheel would be moved down by a cam, putting pressure on the sheet and the lower rotating wheel. This pressure would cause the lower wheel to propel the sheet laterally to a fixed stop block. Problems with this design included the fact that it was difficult to adjust for various sheet widths, difficult to adjust to set the right pressure necessary for pulling various types of sheet stock, and the fact that it could not be moved from one side of the press to the other e.g., from the operator side to the nonoperator side of the press, to perform registry on the opposite side. It was not practical to move it mechanically from one side to the other.

During the 1960s and 1970s, registry devices such as that in U.S. Pat. No. 3,120,180 were used. This involved a vacuum pull guide which became a standard for over 20 years. The brass slide that was used for the push guide was changed to include a vacuum chamber and manifold. The brass slides were mechanically moved laterally a fixed distance in and out by a cam, or moved pneumatically. The vacuum was turned on and off at a predetermined point in the cycle, controlled by a cam and a four way valve. The sheet was first transported linearly up the feed board to the temporary stop which prevented further linear advancement, the vacuum would then be activated and the brass slide moved laterally, carrying the sheet laterally to a fixed stop block. Since the slide had to travel a fixed distance, and the amount of side registry travel required for the sheet would vary based upon its delivery position from the feeder, the operator had to regulate the vacuum suction on the sheet very precisely. This was so that, when the sheet hit the stop block, the vacuum seal to the sheet would break and release the sheet while the slide continued to its fixed position. If there was too much vacuum, the sheet would buckle when it hit the stop. If there was too little vacuum, the sheet would slip and not consistently hit the stop. Further, it was difficult to regulate the amount of vacuum required for accurate registry at various press speeds. It was also difficult to change from a push type to a pull type guide, or visa versa. Further, if the stock was wavy it was difficult to suck it down to the brass slide and hold it while moving the sheet into registry. Additional problems with this design included considerable consumption of time to change it from one side of the press to the other side.

Consequently, in the 1980s, presses in the U.S. tended to employ an imported feeder and side registry system from Germany. In this type of device, the register slides were moved mechanically by a cam located on the feeder. It would push or pull the sheet into registry. The pull guide consisted of a moving gripper finger which would grab the sheet and pull it to a fixed stop block. Tension of the gripping finger i.e. the amount of clamping force on the sheet, was controlled by a spring. The tripping/releasing action of the gripper finger was controlled by two pins located on the fixed stop block. Problems with this design included the fact that the operator had to adjust the cam on the feeder every time he wanted to change from push type to pull type registry, and this was difficult. Also, there were too many mechanical parts which wore out rapidly. Further, to pull heavy stock, the pressure needed from the spring to grip the sheet caused the parts to wear very rapidly, requiring frequent repairs. Finally, it was difficult to set the stop block and pull finger relationship.

A prior type apparatus used on presses for web stock employed a vacuum platen registry system controlled by a linear actuator and photosensitive eye. This worked well on presses printing web stock where the amount of pull to registry was only one-eight inch or less, but such does not respond rapidly enough for a cylinder press printing sheet stock. Until presently therefore, various ones of these above-described registry systems have been employed on sheet printing presses. All of these take considerable time to complete the registry.

Some presses are understood to use a vacuum pull guide in conjunction with a photoelectric eye sensor, although it is not known by the inventors herein how the sensor activates or controls the vacuum platen.

There is often a need to reliably move sheet stock up to one-half inch for registry, and a requirement to do so in a fraction of a second.

SUMMARY OF THE INVENTION

An object of this invention is to provide an improved print registry system for a sheet feed cylinder press, which registry system is easier to use, more reliable, and improves the overall performance. Moreover, it is operable in only a fraction of a second to achieve accurate registry. Specifically, the present apparatus is capable of accomplishing sheet registry in two-tenths of a second. This enables greater production rates.

The novel registry system has a combination employing two significant improvements, one being the use of a small fluid cylinder, preferably an air cylinder, located above the sheet, cooperable with an anvil-type slide, preferably a brass slide, below the sheet, the two being commonly supported to move laterally in and out together. The cylinder and anvil provide a positive clamping action of the sheet at the appropriate time, the air cylinder also subsequently rapidly retracting at the appropriate time to release the sheet and allow the sheet to continue through the printing process. Secondly, the slide forming the anvil and supporting the air cylinder is moved by a precisely positioning servo system controlled by a photosensitive eye. The servo system is reversible and employs a screw and nut. The system preferably uses two slides mounted on opposite sides of the feed board plate, these slides being movable laterally simultaneously in either direction, even up to one-half inch. They are connected together under the feed board and driven by the same servo motor connected to the precision lead screw to convert rotatory motion to linear motion. The servo motor drives the lead screw, i.e., screw, which moves the nut, which in turn moves the brass slides in one direction or the other.

A control signal is sent to the servo motor to begin its cycle. It moves a programmed speed of approximately 1500 rpm and causes the brass slide to travel up to one-half inch laterally. To control the proper stopping location, a photoelectric eye is mounted above the feed board and senses the edge of the sheet being shifted into registry. The sheet travels sideways, pinched between the foot of the air cylinder and the upper anvil surface of the brass slide, until the photoelectric eye has sensed the sheet in the proper location. Upon sensing this, the photoelectric eye sends an electrical signal to stop the servo motor from rotating. At a predetermined point in the cycle the brass slide returns to its starting point and waits for the next signal, to begin again. Limit switches limit the amount of travel of the slide and cause resetting of the servo system.

DESCRIPTION OF THE PREFERRED EMBODIMENT

Figure 1:
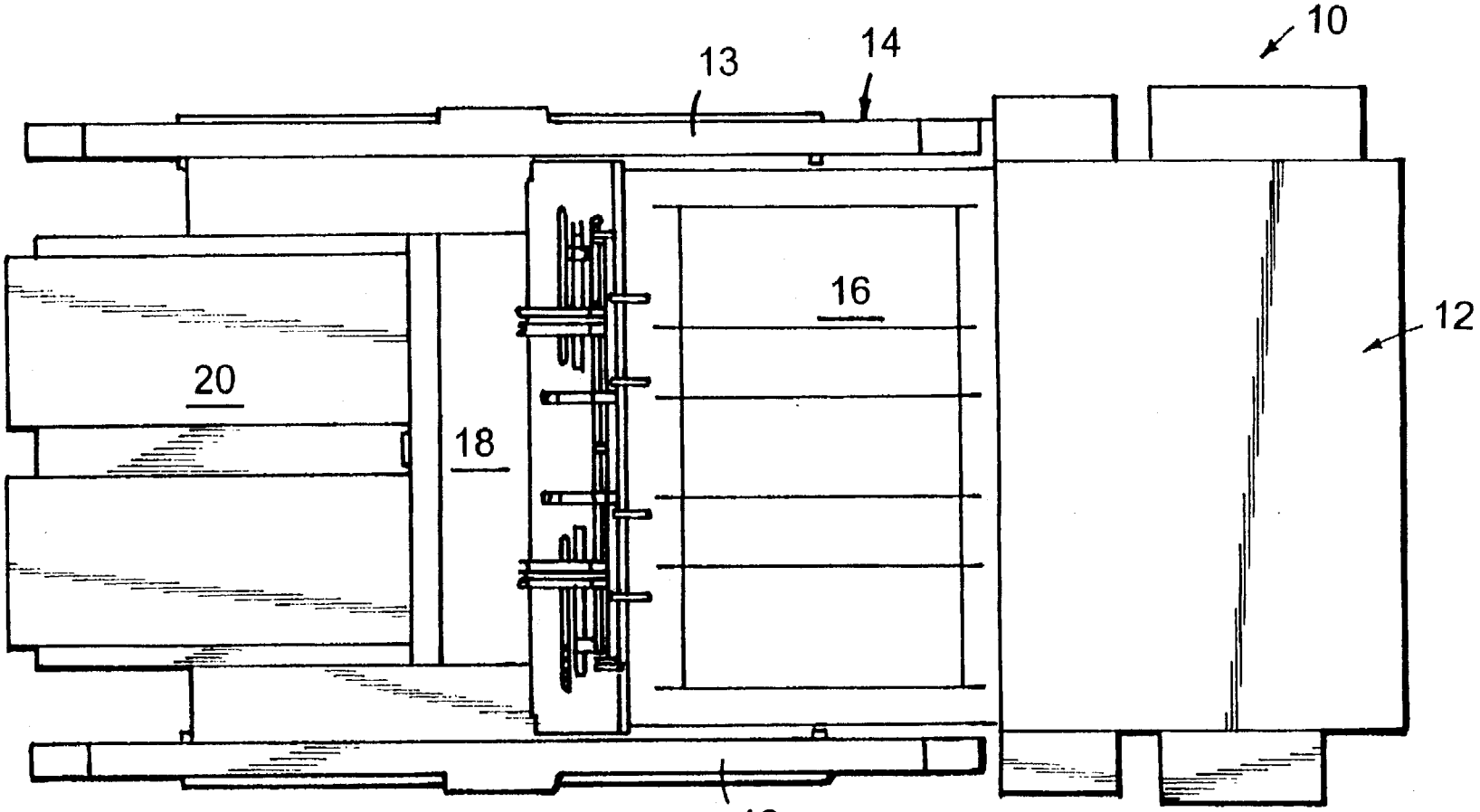
FIG. 1 is a plan view of a press employing this invention.

Referring now specifically to the drawings, there is depicted a stencil type sheet printing press 10 of the type generally set forth in U.S. Pat. No. 3,941,053 which is incorporated herein by reference. It includes the conventional components of a sheet storage and supply mechanism 12, a framework 14 including a pair of side frames 13 supporting the entire assembly, a sheet infeed table 16, a rotational print cylinder 18, a squeegee assembly (not shown), a reciprocating stencil screen frame holder (not shown) and a discharge table 20.

Figures 4, 6, 8, 8A, 8B:
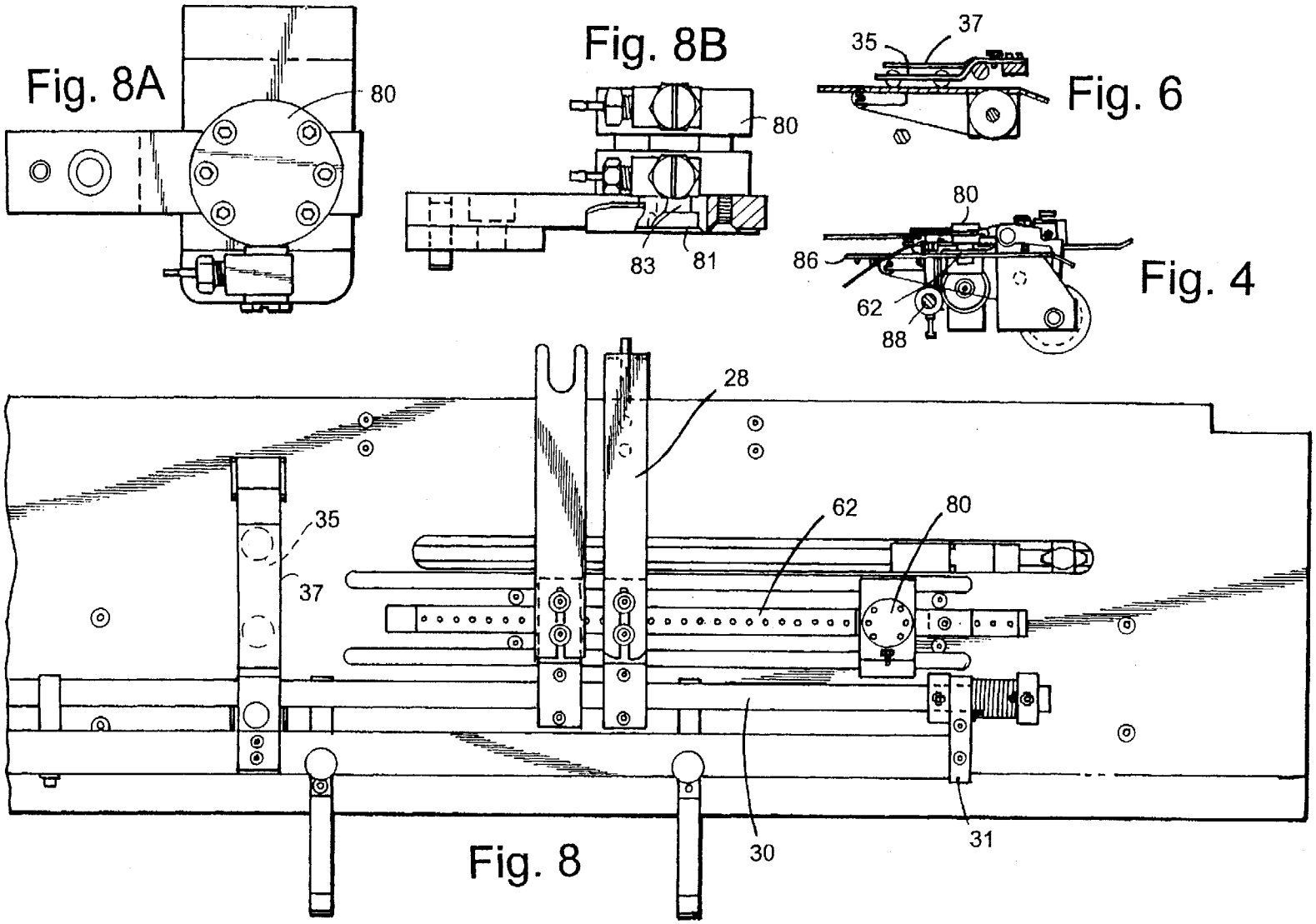
FIG. 4 is an elevational view taken on plan IV—IV of FIG. 3.
FIG. 6 is a sectional view taken on plan VI—VI of FIG. 3.
FIG. 8 is an enlarged plan view of the right side portion of the apparatus in FIG. 3.
FIG. 8A is an enlarged plan view of one clamping cylinder.
FIG. 8B is an enlarged elevational view of the clamping cylinder in FIG. 8A.

These are conventional well known components of such a stencil screen printing press mechanism of the type, for example, set forth in U.S. Pat. No. 3,941,053. The sheet supply apparatus 12 can include an elevatable table and conventional mechanism to advance sheets one at a time to the infeed table 16. Infeed table 16 typically contains several endless belts which advance the successive sheets up the incline to the peripheral surface of rotational print cylinder 18. The feed board may, for example, use conventional ball bars 35 with ball retainers 37 (FIGS. 3 and 6) for guiding the sheet.

Figures 2, 5, 7, 11, 12B:
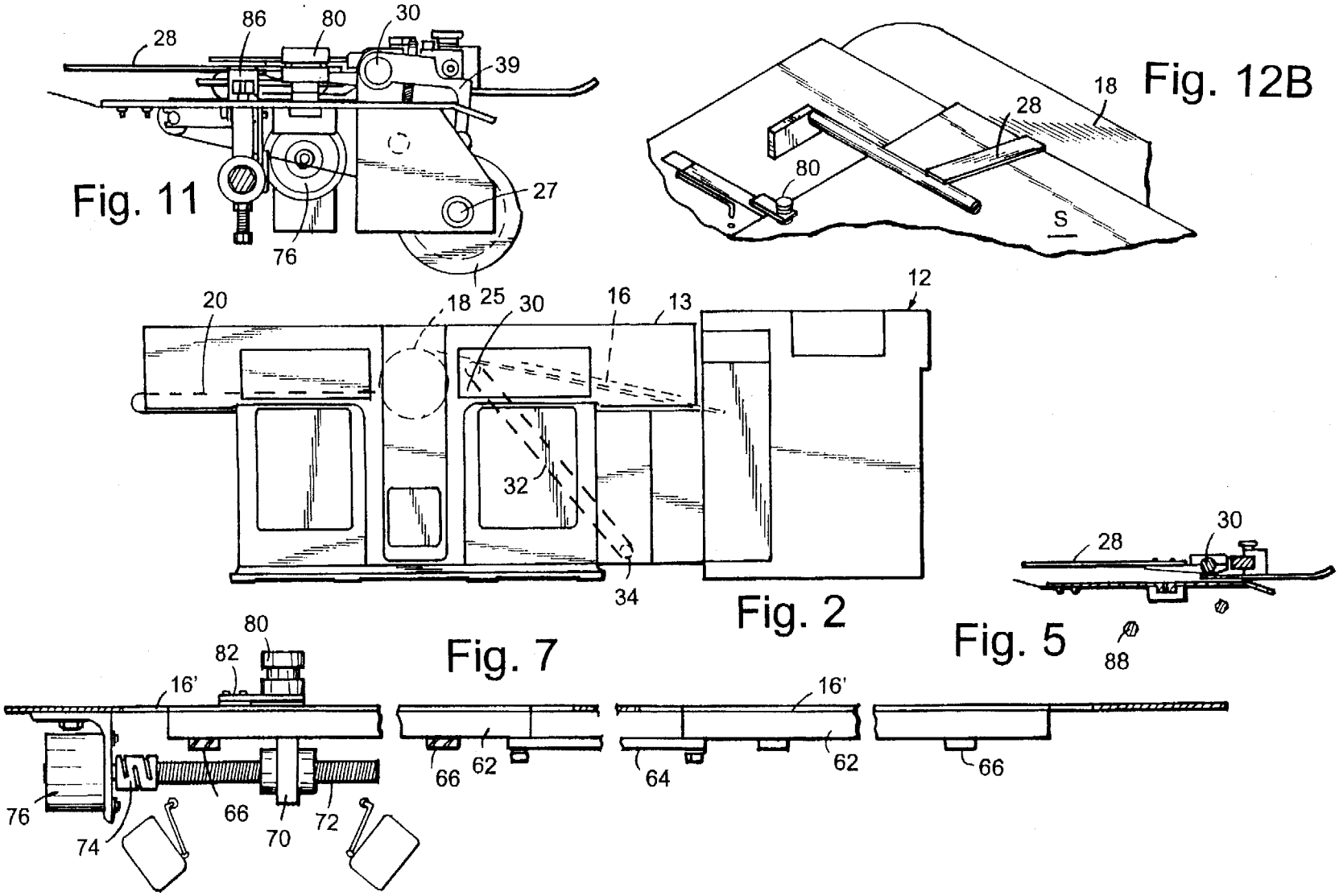
FIG. 2 is a side elevational view of the press in FIG. 1.
FIG. 5 is a sectional view taken on plan V—V of FIG. 3.
FIG. 7 is a fragmentary elevational sectional view showing the primary registration system components.
FIG. 11 is an end elevational view of the apparatus in FIG. 7.
FIGS. 12A–12D are fragmentary isometric views depicting sequential steps during sheet registry.
Figure 10:
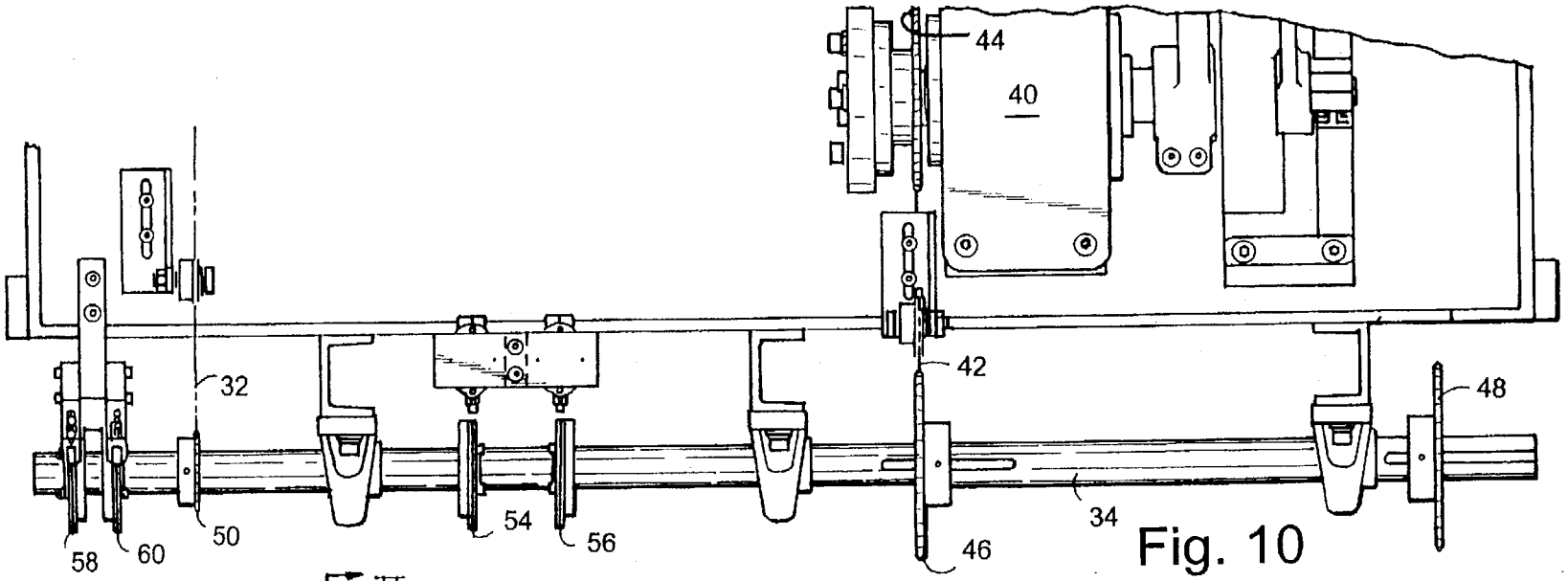
FIG. 10 is a fragmentary elevational view of the jack shaft drive components of the press.
Figure 3:
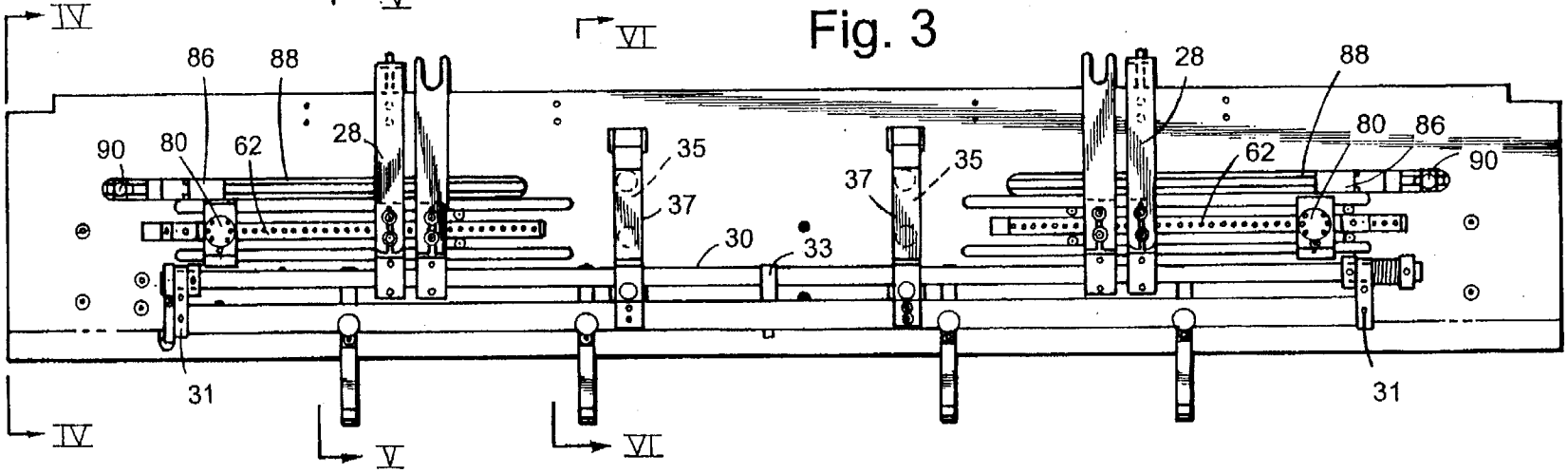
FIG. 3 is a plan view of the registry system in the press of FIGS. 1 and 2.

Print cylinder 18 has an elongated axial recess 24 in its periphery (FIG. 12C) with a pair of sheet grippers 26 located in this slot in conventional fashion. Cylinder 18 is rotated about its central axis and controlled to stop with slot 24 adjacent the upper end of feed board 16 by drive mechanism such as that in U.S. Pat. No. 3,941,053. Also located at the upper downstream end of the feed board is a pair of temporary sheet stops 28 (FIGS. 12A–D). These two, like temporary stops, have a downwardly extending outer end flange 28A which is engaged by the leading edge of sheet stock S. Stops 28 are supported in cantilever fashion by having the rear ends thereof attached to a pivotal shaft 30. Shaft 30 is mounted on a pair of right and left end bearing blocks 31 and a center support 33 (FIG. 3). Shaft 30 is pivotally actuated by a rotary cam 25 (FIG. 11) on a shaft 27. Cam 25 is rotated by an endless drive element 32 such as a chain (FIG. 2) from a jack shaft 34 off the conventional power train of the press. Cam 25 moves a dog-leg cam follower 39 on shaft 30. When stops 28 are pivoted downwardly adjacent cylinder 18, the advancing sheet S will engage stop flanges 28A (FIG. 12B). Thereafter, sheet S will preferably be pushed back, i.e., reversed a small amount, by pushers 36 (FIG. 12C) for exact linear alignment in the direction of the sheet movement relative to the print cylinder and squeegee mechanism. Essentially simultaneously, the sheet will be laterally aligned as explained in more detail hereinafter. Jack shaft 34 is driven from the main drive gear box 40 (FIG. 10) by suitable drives such as an endless chain 42 driven by sprocket 44 and driving sprocket 46 on jack shaft 34. Jack shaft 34 can perform several functions including driving a sprocket 48 to drive the stock feeder which drives the feed table belts mentioned previously, driving the endless drive elements 32 from sprocket 50 for the temporary stops as mentioned previously, operating microswitches 54 and 56, and operating air switches with cams 58 and 60 for the air cylinder forming part of the novel side registry stock gripper device to be explained in more detail hereinafter.

Figure 3A:
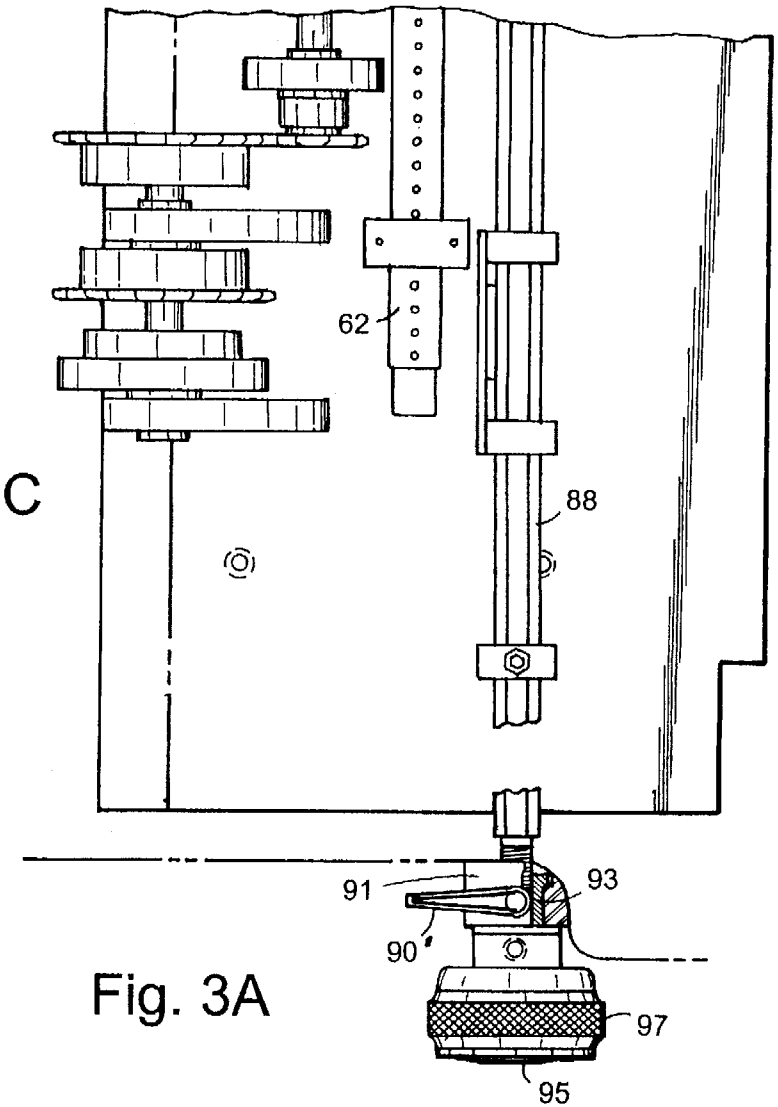
FIG. 3A is a fragmentary plan view of the photoelectric eye adjustment mechanism for the registry system.
Figure 9:
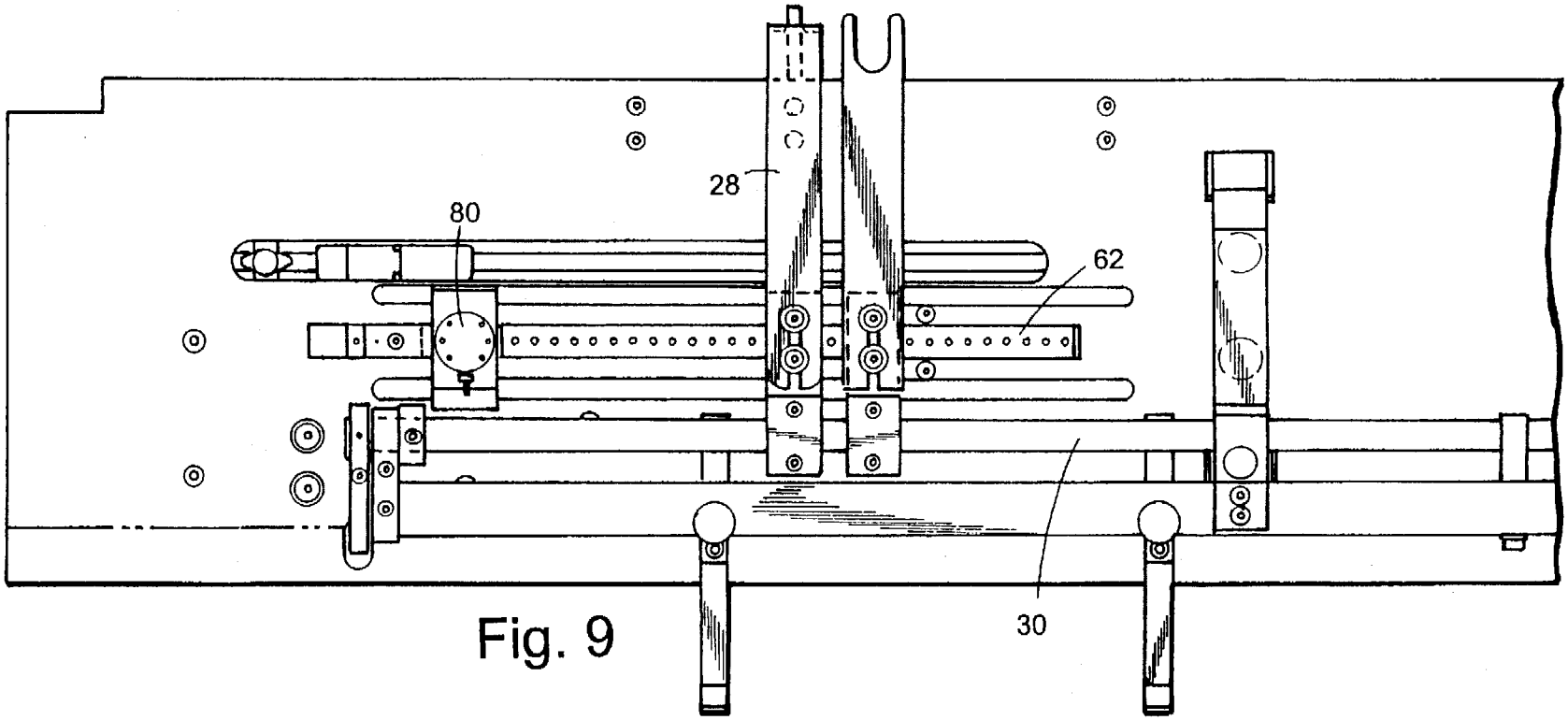
FIG. 9 is an enlarged fragmentary plan view of the left side portion of the apparatus in FIG. 3.

Adjacent the upper end of the feed board plate 16' is the novel side registry mechanism. This is shown to include a laterally movable slide 62, preferably a brass slide, on each side of the press, i.e., on the operator side (left side in FIG. 3) and on the opposite nonoperator side (right side in FIG. 3). These two brass slides 62 are connected together by an underlying connecting bar 64 (FIG. 7) or the equivalent, so as to move laterally simultaneously, supported by guides 66. These brass slides are not vacuum, sheet pulling members as in previous apparatus. Rather, these brass slides are laterally moved transverse to the direction of the sheet feed, and parallel to the axis of the print cylinder, by a nut 70 connected to the brass slides and operably mounted on a lead screw 72. The outer end of screw is rotationally driven in one direction or the other by an electrically actuated, reversible rotary servo motor 76 through a zero backlash coupling 74. This lead screw, nut and antibacklash apparatus are of the type disclosed in U.S. Pat. No. 3,977,269 which is incorporated by reference herein. The components can be obtained from the patent assignee Universal Thread Grinding Co., Fairfield, Conn. The preferred lead screw and nut are designated ½-.200-2". On both sides of the printing press are fiber optic photoelectric eye sensors 86, each of these being mounted on opposite ends of a common, transverse hex shaft 88, and lockable in a preset position on the shaft by a lock knob 90 (FIG. 3). The operator unlocks knob 90 and slides the eye 86 to the desired position on the support shaft, and relocks knob 90. The common hex shaft 88 extends through the operator side of the press side casting 91, and is threaded and captured in a fixed threaded bushing 93 (FIG. 3A) that allows for micro adjustment of the eye position with micro movement of the shaft and eye from outside the press. This means that the operator can change the exact position of the eye and hence the registered sheet position while the press is running. This easy adjustment is helpful in set up and contributes to a higher quality production run. A dial indicator is preferably incorporated into the adjustment knob 97, so that the operator knows the amount of adjustment made. The lever 90' (FIG. 3A) on the bushing assembly secures the micro adjustment to the final desired location of the photo eye. These photoelectric eye sensors can be used alternatively so that registry can be obtained at either side of the press. These sensors send an electrical signal to the respective servo motor to stop the servo and thus the sideways movement of the gripped sheet at the register position. Cooperable with each brass slide 62, i.e. on each of the two sides of the press, is a fluid cylinder, specifically a stock clamping air cylinder 80, which is vertically aligned with the upper surface of the respective brass slide so that the extending foot 81 (FIG. 8B) connected to the piston rod 83 of the cylinder will be shifted downwardly to the underlying brass slide to grip a sheet therebetween. The brass slide upper surface thus acts as an anvil forming one half of the gripper. Each cylinder 80 moves laterally with brass slide 62 because it is mounted to it as by a bracket 82. Thus the brass slide or other connected components serve as a common support for the anvil surface and the cylinder so that lateral movement of both of these occur synchronously. A second like cylinder 80 is located on the left side (FIG. 9) of the structure, aligned with the other brass slide in the same fashion. Thus, the sheet stock can be pulled in either of two directions, i.e. either on the operator side or the opposite side of the press.

Figure 13:
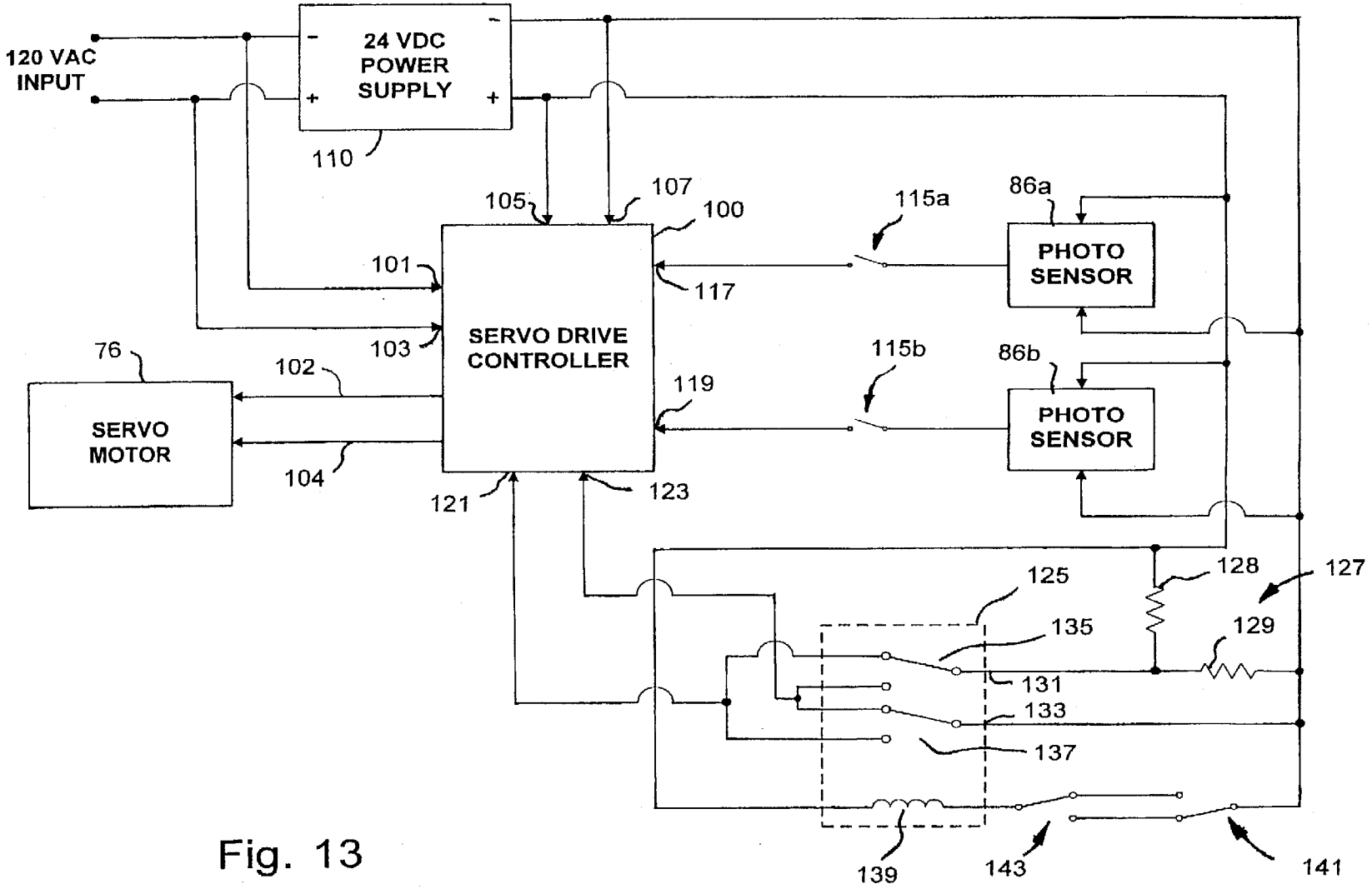
FIG. 13 is an electric circuit diagram in block form of the electric circuitry used to drive a servo motor used in the present invention.

The electric circuit used to drive and actuate servo motor 76 is shown in FIG. 13. The electric circuit includes a servo drive controller 100 that is coupled to servo motor 76 to provide power and control signals to servo motor 76 via lines 102 and 104, respectively. Preferably, servo motor 76 is model SGM-A3B-314 and servo drive controller 100 is model SGDA-A3B5 both available from Yaskawa, although other suitable components may be used. The control signal sent to servo motor 76 by servo drive controller 100 includes control signals regulating the direction and speed as well as the actuation and deactuation of servo motor 76. Servo drive controller 100 receives power from a 120 VAC power source at a positive power input terminal 103 and a negative power input terminal 101. Additionally, servo drive controller 100 includes a positive DC power input 105 and a negative DC power input terminal 107 for receiving 24-volt DC power from a 24 VDC power supply 110 that generates the 24-volt DC power from the 120 VAC power source.

The power generated by power supply 110 is also provided to an operator-side photoelectric eye sensor **86*a* and a nonoperator-side photoelectric eye sensor 86*b*. As discussed above, photosensors 86*a* and 86*b* generate an electric signal when the edge of a sheet is detected to stop servo motor 76 from pulling this sheet in the lateral direction. This electric signal may be a constant high level voltage, or a low level open circuit voltage as in the preferred embodiment. Photosensors 86*a* and 86*b* may be any form of photoelectric eye sensor and are preferably model No. SEBF1 available from Tritronics, which include a fiberoptic cable (not shown) that transmits a beam of light in a vertical direction against a reflector that reflects the light back to the fiber optic cable such that the reflected light may be sensed by a photodetector. When the reflected light is no longer sensed by the photodetector, it generates a low voltage level electric signal that is applied through a respective limit switch 115*a* and 115*b* to one of two rotation-prohibiting input terminal 117 and 119 of servo drive controller 100. Rotation-prohibit input terminal 117 is an input terminal commonly found on servo drive controllers that prohibit rotation in a reverse direction in response to a low (or high) voltage level applied thereto. Similarly, rotation-prohibit input terminal 119 of servo drive controller 100 responds to a low voltage level applied thereto by prohibiting the forward rotation of the servo motor. In the particular embodiment shown, reverse rotation-prohibit input terminal 117 is coupled to receive the output signal from the operator-side photosensor 86*a* and forward rotation-prohibit input terminal 119 is coupled to receive the signal generated by the nonoperator-side photosensor 86*b***.

Limit switches **115*a* and 115*b* are mechanically-actuated switches that are responsive to movement of nut 70 which is mounted to lead screw 72 that is driven by servo motor 76. These limit switches 115*a* and 115*b* are normally closed so that the electric signal from the respective photosensors 86*a* and 86*b* may be applied to terminals 117 and 119 of servo drive controller 100. To prevent servo motor 76 from rotating lead screw 72 so far that nut 70 moves off the threads of lead screw 72, limit switches 115*a* and 115*b* sense the position of nut 70 and open when nut 70 is close to becoming disengaged from lead screw 72. When one or both of limit switches 115*a* and 115*b* are opened, servo drive controller 100 senses the low voltage level at terminals 117 and 119 and thereby prohibits any further rotation of servo motor 76. Once nut 70 is moved in the opposite direction by a sufficient distance, limit switches 115*a* and 115*b* close to allow photosensors 86*a* and 86*b* to control the halting of rotation by servo motor 76**.

Servo drive controller 100 controls servo motor 76 to begin rotation in a forward or reverse direction in response to the voltage levels applied to direction control input terminals 121 and 123 of servo drive controller 100. Input terminals 121 and 123 are voltage reference input terminals for controlling the direction of rotation whereby servo drive controller 100 responds to the voltage level applied at terminal 121 by causing servo motor 76 to rotate in a forward direction while responding to the voltage level applied at terminal 123 by causing servo motor 76 to rotate in a reverse direction. The voltage levels applied to terminals 121 and 123 are selected through operation of a relay 125 that applies either the voltage at the negative terminal of 24 VDC power supply 110 or a higher voltage output from a voltage divider 127 to terminal 121 while applying the other one of these two voltage levels to terminal 123. Voltage divider 127 includes a first resistor 128, which preferably has a resistance of 10 kΩ, coupled between the positive voltage terminal of power supply 110 and a first input terminal 131 of relay 125, and a second resistor 129, which preferably has a resistance of 5 kΩ, connected between the negative terminal of power supply 110 and the first input terminal 131 of relay 125. Relay 125 preferably includes two parallel switches 135 and 137 that are both simultaneously moved between normally-open and normally-closed contact terminals in response to current flowing through a coil 139. First terminal 131 of relay 125 is connected to first switch 135 while a second input terminal 133 of relay 125 connects second switch 137 to the negative terminal of power supply 110. As shown in FIG. 13, the normally-open contact terminal of switch 135 and the normally-closed contact terminal of switch 137 are both coupled to input terminal 123 of servo drive controller 100 while the normally-closed contact terminal of switch 135 and the normally-open contact terminal of switch 137 are both coupled to input terminal 121. With this arrangement, when switches 135 and 137 are both in their normally-closed positions as shown in FIG. 13, the voltage output from voltage divider 127 is applied to terminal 121 while the negative voltage level generated by power supply 110 is applied to terminal 123. When current flows through coil 139, switches 135 and 137 move in parallel to their normally-open contact terminals such that the voltage level output from voltage divider 127 is then applied to input terminal 123 while the negative voltage level generated by power supply 110 is applied to input terminal 121. Thus, the voltage levels appearing at terminals 121 and 123 are switched back and forth in a manner that prevents the voltage levels appearing at these terminals from ever being the same at any particular instant in time.

To control the state of relay 125, a cycle switch 141 is coupled between coil 139 and the negative terminal of power supply 110. Cycle switch 141 is a mechanically-actuated switch that is driven between its two switching states by a cam. The cam rotates and moves cycle switch 141 at a rate corresponding to the printing cycles of each successive sheet to be printed, thereby causing servo motor 76 to switch between forward and reverse rotations at the appropriate times for printing successive sheets.

Because servo motor 76 must rotate in opposite directions depending upon whether the sheet is to be aligned with the operator side or the nonoperator side, a selector switch is provided to enable the operator to select which side the sheet is to be aligned on. This switch mechanically moves a switch 143 that is coupled between cycle switch 141 and coil 139 to effectively shift the phase by 180° at which servo motor 76 changes rotation direction.

Figure 12D:
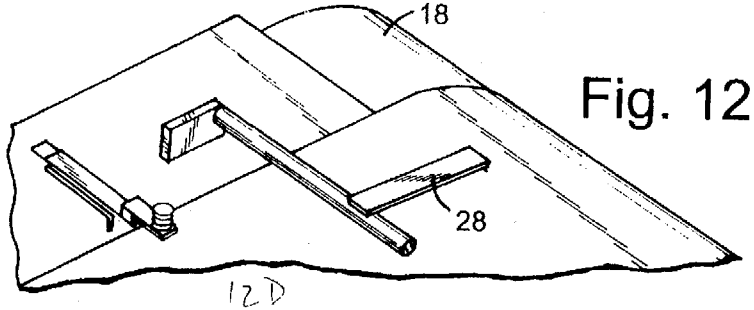
Figure 12C:
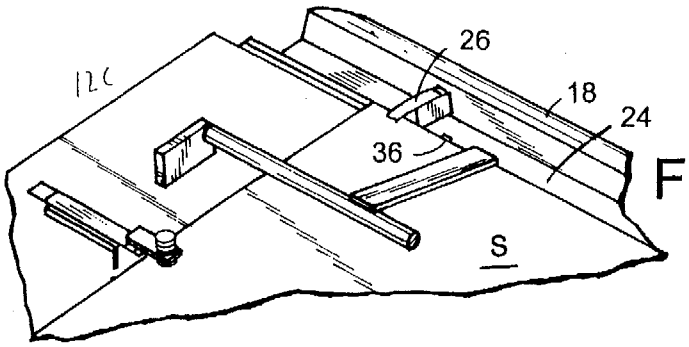
Figure 12A:
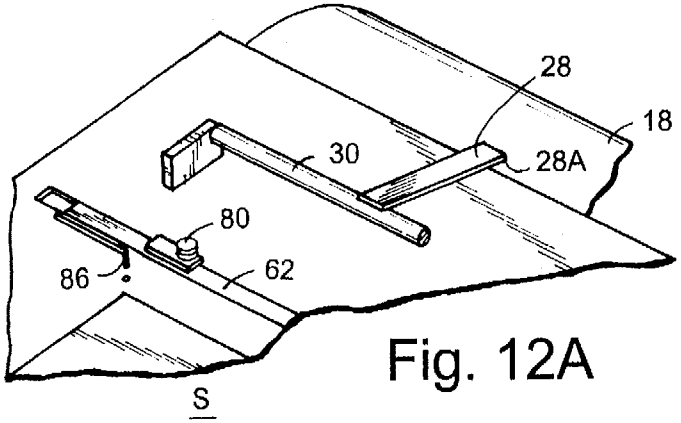

In operation therefore, as successive sheets are transferred from the supply unit 12 to the feed board 16, and are elevated up the feed board to cylinder 18 (FIGS. 12A and 12B), the forward edge of the sheet S strikes against the flanges 28A of temporary stops 28. The cycle switch is actuated by its cam to initiate the registry operation. As the temporary stops retain sheet S, the air cylinder 80 lowers its foot to press sheet S between it and brass slide anvil 62. Next, the slide guide clamp slides the sheet toward electric eye sensor 86 as depicted in FIG. 12C until a sensor 86 detects the edge of the sheet, at which location the clamp stops moving. This occurs by the photoelectric eye sensor deactuating servo motor 76 to halt the lateral movement of screw 72 and nut 70 and thus of the cylinder 80 and slide anvil 62. Cylinder 80 then retracts its foot upwardly and push-back elements 36 reverse the sheet linearly a small amount to assure linear alignment of the sheet in the feed direction. The entire registration can actually be accomplished in about two-tenths of a second, such that printing operations can be extremely rapid. Conventional grippers 26 (FIG. 12C) then grip the forward edge portion of aligned sheet S, cylinder 80 has been retracted, temporary stops 28 are elevated to release the forward edge of the sheet, and cylinder 18 rotates to advance the sheet through the print stroke beneath the squeegee as the stencil screen advances. During this print stroke, servo motor 76 returns cylinder 80 and slide 62 to the start position.

This same registry system can be used as a conventional push guide for push registry of thick sheets on either side of the press. In this push registry mode, the servo motor drives the brass slide a fixed distance, e.g., ½". This distance is set by the location of the travel limit micro switch. When using this push registry mode, the pneumatic clamp cylinder is inactivated.

Those familiar with this area of technology will conceive of variations of the specific preferred construction shown and described as exemplary of the invention, while employing the unique concept set forth. Therefore, this invention is not intended to be limited to the specific preferred embodiment depicted and described in detail, but only by the scope of the appended claims and the equivalents thereto.

The embodiments of the invention in which an exclusive property or privilege is claimed are defined as follows:

1. A printing press electronic side guide registry apparatus for stock to be printed, for a printing press having a print cylinder, print stock forward motion advancer through the print cylinder, and a forward motion registry stop, comprising:

a laterally movable, side registry, stock gripper device comprising a slide anvil positioned to be adjacent one surface of the stock, and a fluid cylinder positioned to be adjacent the opposite surface of the stock, aligned with said slide anvil;

said fluid cylinder having a piston foot shiftable toward said slide anvil to grip sheet stock therebetween, and shiftable away from said slide anvil to release the sheet stock;

a common, laterally-shiftable support for both said slide anvil and said fluid cylinder, said support being movable in opposite lateral directions transverse to sheet stock forward motion;

a driver including a servo motor operably connected to said support to drive said support transverse to said sheet stock forward motion;

said driver comprising a nut connected to said support, and a laterally extending screw operably engaging said nut, said servo motor comprising a reversible rotational servo motor and a zero backlash coupling drivingly connected with said screw for rotation of said screw to laterally drive said nut, said support, said fluid cylinder, and said slide anvil in either of two opposite directions; and a sheet edge detector including a sensor electrically associated with said servo motor to controllably actuate and deactuate said servo motor, whereby the presence of stock at a print station will cause said fluid cylinder to shift and grip the stock against said slide anvil, and cause said servo motor to be actuated to move said slide anvil, said fluid cylinder and the stock toward said sensor until said sensor senses the stock to cause said servo motor to be deactuated.

2. The printing press electronic side guide registry apparatus in claim 1 wherein said fluid cylinder is an air cylinder.

3. The printing press electronic side guide registry apparatus in claim 2 wherein said sheet edge detector comprises a photoelectric sensor.

4. The printing press electronic side guide registry apparatus in claim 3 wherein said laterally shiftable support comprises a slide having said slide anvil at the upper surface thereof and on which said air cylinder piston foot grips sheet stock.

5. The printing press electronic side guide registry apparatus in claim 4 wherein said slide has portions on each side of said apparatus and said registry apparatus includes a sensor on both sides of said press and an air cylinder with piston foot on both sides of said press, for sheet registry on either side of the press.

6. The printing press electronic side guide registry apparatus in claim 4 including a transverse support for said photoelectric sensor, and said photoelectric sensor is transversely adjustable on said transverse support.

7. The printing press electronic side transverse guide registry apparatus in claim 6 wherein said transverse support has a threaded engagement with said press for micro adjustment laterally of said transverse support relative to said press to enable said transverse support and said sensor to be micro adjustable relative to said press.

8. A printing press electronic side guide registry apparatus for stock to be printed, for a printing press having a print cylinder, print stock forward motion advancer through the print cylinder, and a forward motion registry stop, comprising:

a laterally movable, side registry, stock gripper device comprising a slide anvil positioned to be adjacent one surface of the stock, and a fluid cylinder positioned to be adjacent the opposite surface of the stock, aligned with said slide anvil;

said fluid cylinder having a piston foot shiftable toward said slide anvil to grip sheet stock therebetween, and shiftable away from said slide anvil to release the sheet stock;

a common, laterally-shiftable support for both said slide anvil and said fluid cylinder, said support being movable in opposite lateral directions transverse to sheet stock forward motion;

a nut connected to said support, and a laterally extending screw operably engaging said nut;

a reversible rotational servo motor and a zero backlash coupling drivingly connected with said screw for rotation of said screw to laterally drive said nut, said support, said fluid cylinder and said slide anvil; and a sheet edge detector electrically associated with said servo motor to controllably actuate and deactuate said servo motor, whereby the presence of stock at a print station will cause said fluid cylinder to shift and grip the stock against said slide anvil, and cause said servo motor to be actuated to rotate said screw and thereby move said nut, said slide anvil, said fluid cylinder and the stock toward said sensor until said sensor senses the stock to cause said servo motor to be deactuated, and away from said sensor in a return movement.

9. The printing press electronic side guide registry apparatus in claim 8 wherein said fluid cylinder is an air cylinder.

10. The printing press electronic side guide registry apparatus in claim 8 including a transverse support for said sensor, and said sensor being transversely adjustable on said transverse support; and said transverse support having a threaded engagement with said press for micro adjustment laterally of said transverse support relative to said press to enable said transverse support and said sensor to be micro adjustable relative to said press.

* * * * *

UNITED STATES PATENT AND TRADEMARK OFFICE

CERTIFICATE OF CORRECTION

PATENT NO. : 5,893,557
DATED : April 13, 1999
INVENTOR(S) : Gregory M. Beduhn and Arthur E. Proctor It is certified that error appears in the above-identified patent and that said Letters Patent is hereby corrected as shown below:

Column 1, line 5;
"Ser. No. 60/606,620" should be -- Ser. No. 60/006,620 --;

Column 9, claim 7, line 21;
After "side" delete "transverse".

Signed and Sealed this

Twenty-third Day of November, 1999

*Attest:*

Q. TODD DICKINSON

*Attesting Officer*

*Acting Commissioner of Patents and Trademarks*